United States Patent [19]
Price
[11] 4,326,464
[45] Apr. 27, 1982

[54] GUSSET DISCARDING SABOT MUNITION

[75] Inventor: Renata F. Price, Morris City, N.J.
[73] Assignee: The United States of America as represented by the Secretary of the Army, Washington, D.C.

[21] Appl. No.: 102,084
[22] Filed: Dec. 10, 1979
[51] Int. Cl.[3] ..... F42B 13/16
[52] U.S. Cl. ..... 102/523; 102/518
[58] Field of Search ..... 102/93, 52, 520, 521, 102/523, 518

[56] References Cited

U.S. PATENT DOCUMENTS 3,496,869 2/1970 Engel ..... 102/93
3,905,299 9/1975 Feldmann ..... 102/93
3,948,184 4/1976 Pierre ..... 102/93
4,215,632 8/1980 Sie ..... 102/93

FOREIGN PATENT DOCUMENTS 765169 1/1957 United Kingdom ..... 102/93

*Primary Examiner*—Harold J. Tudor
*Attorney, Agent, or Firm*—Nathan Edelberg; Robert P. Gibson; Max Yarmovsky

[57] ABSTRACT

A discarding sabot munition utilizes a plurality of gusset strengthened sabot segments to structurally support and spacially position fore and aft bore-riding sabot members to reduce connecting mid-section mass. Radially disposed gusset plates permit a fin-stabilized projectile to be safely launched by a reduced mass sabot with increased velocity and kinetic energy.

4 Claims, 7 Drawing Figures

GUSSET DISCARDING SABOT MUNITION

GOVERNMENTAL INTEREST

The invention described herein may be manufactured, used and licensed by or for the Governmental purposes without the payment to me of any royalty thereon.

BACKGROUND OF THE INVENTION

Various means have been used in the prior art to increase the leathality and penetration capabilities of a fin stabilized kinetic energy projectile against armored targets. In the past, one of the means used for accomplishing this task has been to fire a subcaliber projectile from a gun of large caliber. An axisymetrically shaped sabot was used to adapt a small projectile to the larger size gun. In order to reduce wind drag on the sabot-projectile assembly, the sabot was designed to fall away from the projectile after exiting from the gun muzzle, leaving the fin-stabilized projectile to continue on toward the target at high velocity. Recent advances in armor design have necessitated further improvements in ammunition design. In the aforementioned prior art discarding saddle-type sabot round, the destructive force of the round is dependent upon the amount of kinetic energy that the round is able to transfer to the target on impact rather than upon a chemical reaction force created by an explosion. Since kinetic energy $(K.E)=\frac{1}{2}m\ v^2$, the efficiency of the kinetic energy projectile varies proportionally to the mass (m) and to the square of the velocity (v) of the round. It is obvious from this relationship that one can best increase a round's effectiveness by increasing and maintaining higher velocities. Thus with the aid of a discarding type sabot a small piece of a dense material in the form of a projectile can be accelerated to a velocity much higher than could a far heavier full size projectile. A problem with simply increasing velocity of a given mass in prior art gun systems is the safety limitations placed upon the gun by its length and maximum allowable chamber pressure. Prior art discarding type sabots frequently used bore rider structural elements to help stabilize the sabot projectile assembly travel through the gun bore. In the past these bore rider elements were generally connected together by a mass having a solid body of revolution. The saddle shape of this mass was selected mainly to facilitate machining by conventional techniques, but much of the mass was not required to join necessary components or to insure structural strength.

PRIOR ART STATEMENT

There is no known prior art gusset shaped discarding sabots that utilize the gusset configuration to reduce sabot mass while maintaining structural strength.

SUMMARY OF THE INVENTION

The present invention relates to a gusset shaped discarding sabot for a kinetic energy subcaliber fin-stabilized projectile. A plurality of segmented gusset shaped sabot sections, having longitudinal grooves therein for weight reduction purposes, are operatively disposed circumabient a kinetic energy dense core projectile to structurally support and spacially position fore and aft bore-riding sections of the sabot to enable the projectile to be fired at higher muzzle velocity and with greater flight stability.

The present invention provides a gusset shaped discarding type sabot for a fin-stabilized kinetic energy round which will impart increased velocity to a subcaliber projectile without an increase of propellant charge or chamber pressure.

The present invention additionally provides a segmented gusset shaped discarding type sabot having reduced inbore sabot mass which enables a kinetic energy subcaliber fin-stabilized round to be fired with greater muzzle velocity.

The present invention further provides a segmented gusset discarding sabot round with improved leathality and accuracy by reducing the mass of the sabot while spacially and structurally supporting bore riding sections of the sabot segments.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENT

Figure 2:
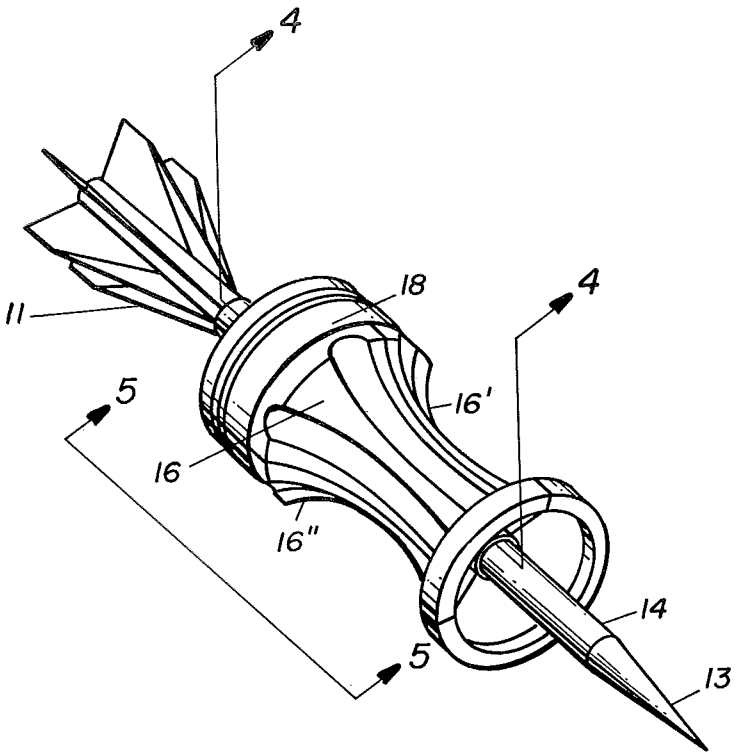
FIG. 2 is an isometric view of a segmented gusset discarding type sabot supporting a kinetic energy subcaliber fin-stabilized projectile.
Figure 1:
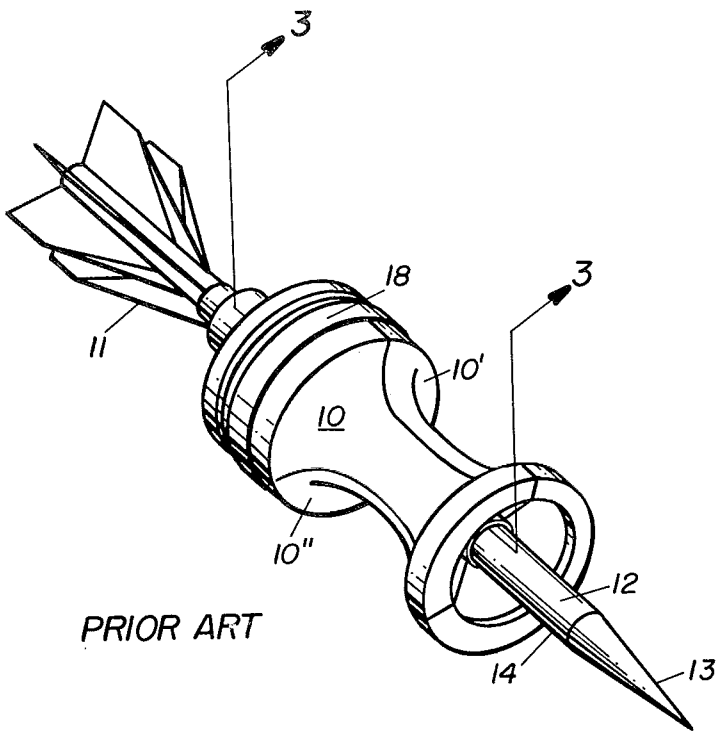
PRIOR ART FIG. 1
FIG. 1 is an isometric view of a prior art segmented saddle shaped discarding sabot supporting a kinetic energy subcaliber fin-stabilized projectile.

Referring now to FIG. 1, in the prior art a plurality of saddle-shaped sabot segments 10, 10' and 10'' are circumambiently disposed on the cylindrically shaped body section 12 of a subcaliber kinetic energy type fin-stabilized projectile 14 intermediate fin-stabilized rear end 11 and a pointed front end 13.

In a similar fashion in the present invention a plurality of gusset-shaped sabot segments 16, 16' and 16'' are operatively positioned on a kinetic energy projectile 14'.

Figure 3:
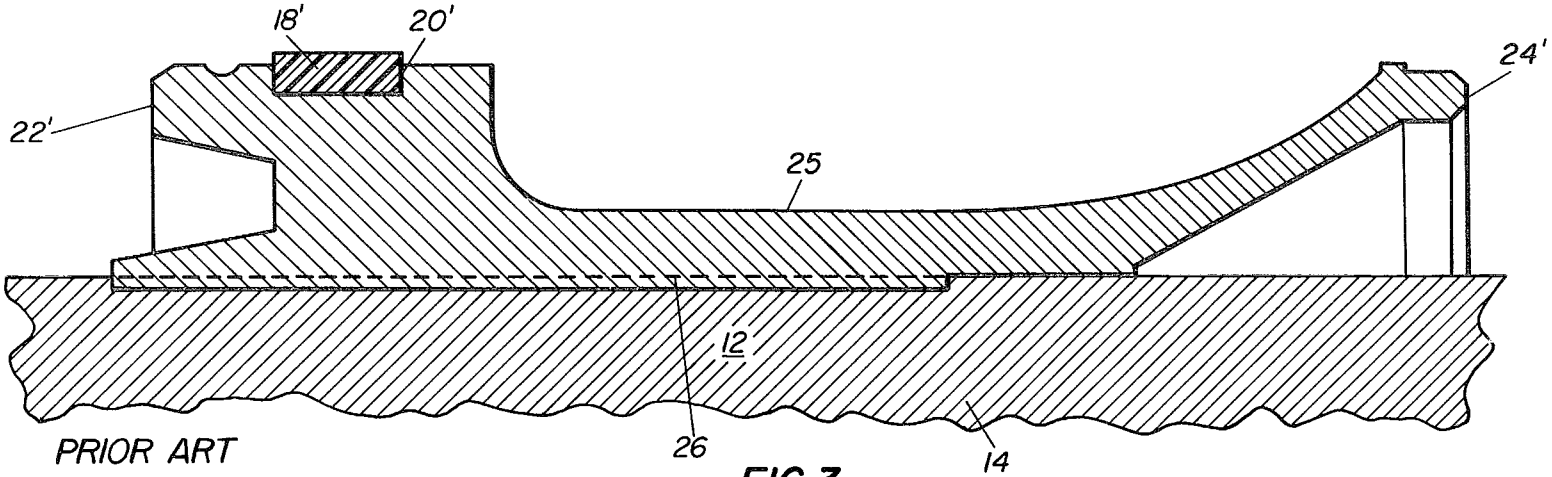
FIG. 3 PRIOR ART
FIG. 3 is partial cross-sectional view of a prior art segmented saddle type discarding sabot and subcaliber projectile taken along line 3—3 of FIG. 1.
Figure 4:
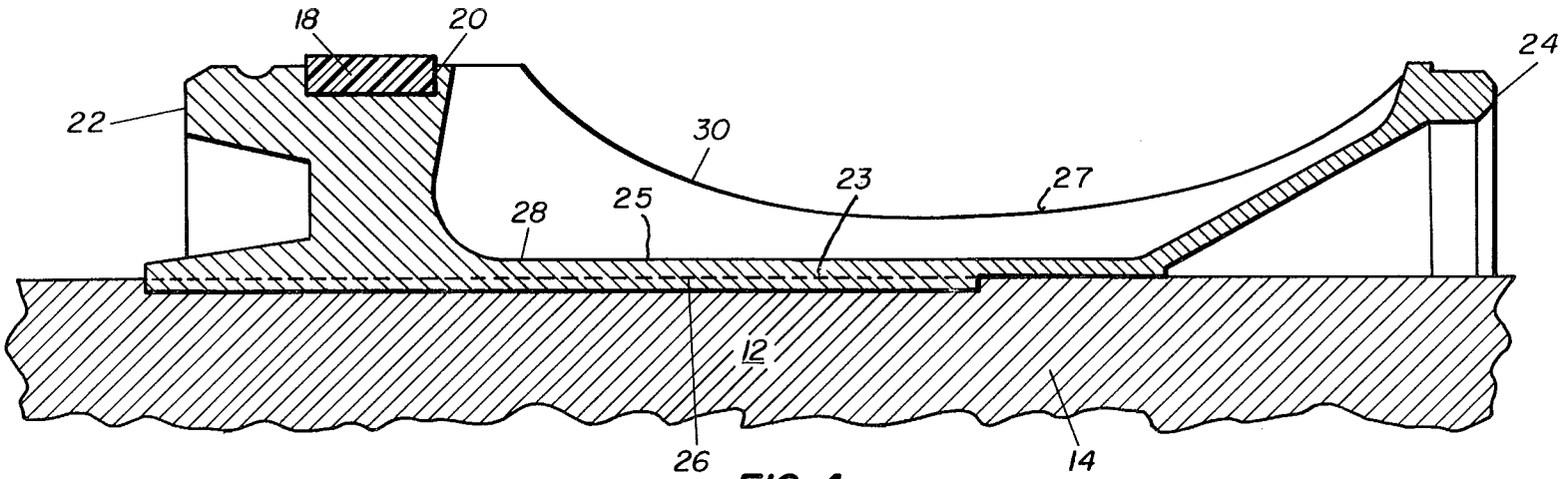
FIG. 4 is a partial cross-sectional view of a segmented gusset type discarding sabot and subcaliber projectile taken along line 4—4 of FIG. 2.
Figure 5:
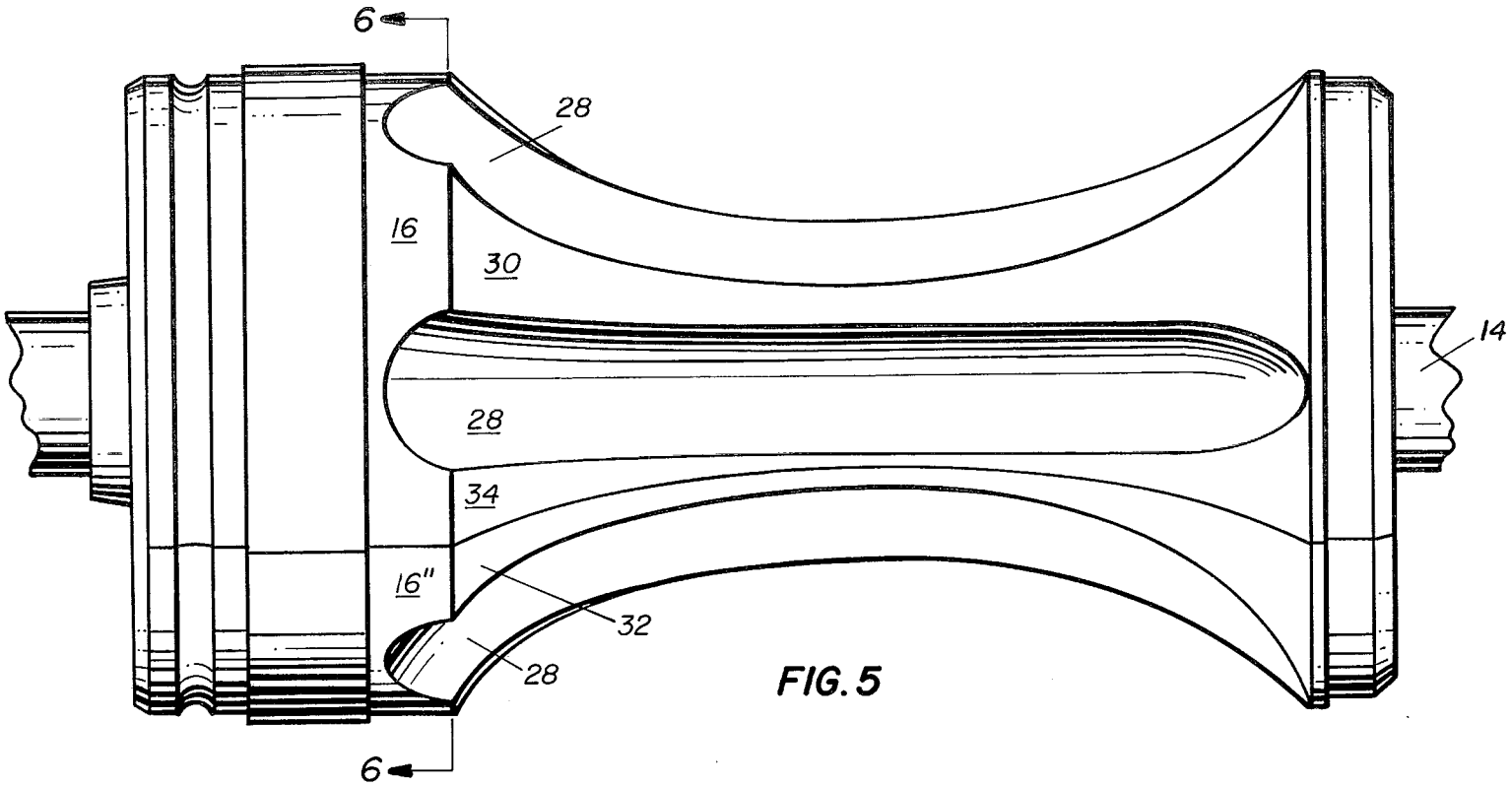
FIG. 5 is an enlarged partial elevational view of an improved sabot-projectile assembly taken along line 5—5 of FIG. 2.

Referring now to FIGS. 3 and 4, frangible obturating rings 18', 18 are operatively peripherally located in sabot rear end 22', 22 in annular ring grooves 20', 20 respectively. Obturating ring 18', 18 are normally designed to prevent leakage of the propellant gases, and in this instance in addition to fail in tension and fracture when the sabot exits from the muzzle of a launch weapon, not shown. Gas pressure acting on sabot rear end 22', 22 and ram air pressure acting on sabot bore rider front ends 24', 24 cause the sabot segments 10, 10', 10'' and 16, 16', 16'' respectively to fly radially away from the projectile 14 at muzzle exit. The obturating ring 18 and bore rider front end 24 help prevent the subcaliber projectile 14 from balloting or wobbling in the launch weapon during launch. A plurality of external circular body threads are disposed in a portion of the cylindrical body section 12 and interlock with a plurality of arcuate internal sabot grooves located on an internal surface of sabot body midsection 23. The aforementioned interlocking projectile body threads and sabot buttress grooves are symbolically represented by dash lines 26. These interlocking threads and buttress grooves 26 help transfer the propellant force acting on the sabot rear ends 22 and 22' to the projectile 14.

Figure 6:
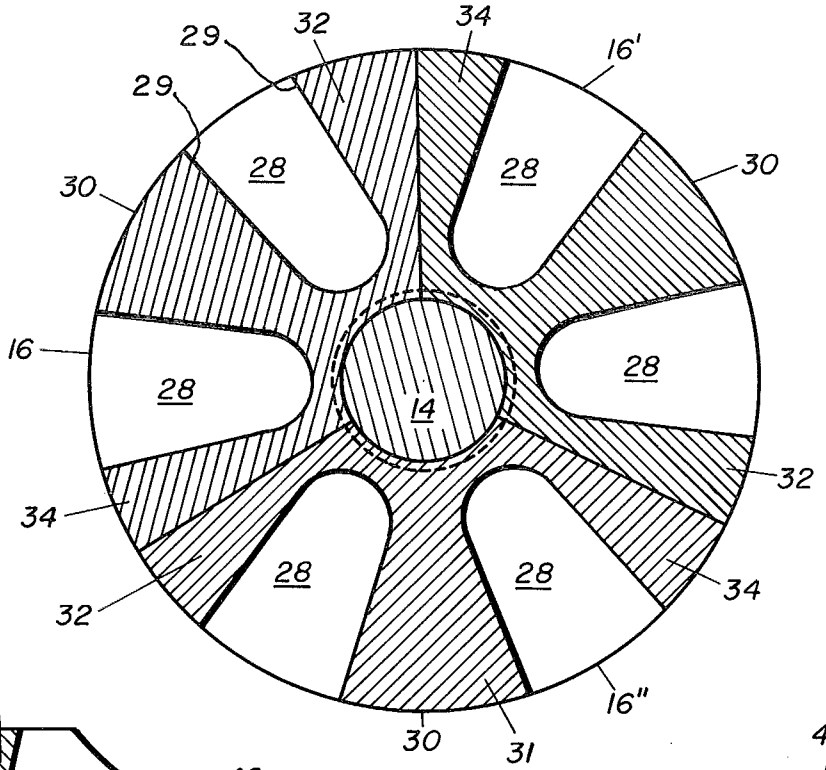
FIG. 6 is a cross-sectional view taken along line 6—6 of FIG. 5.
Figure 7:
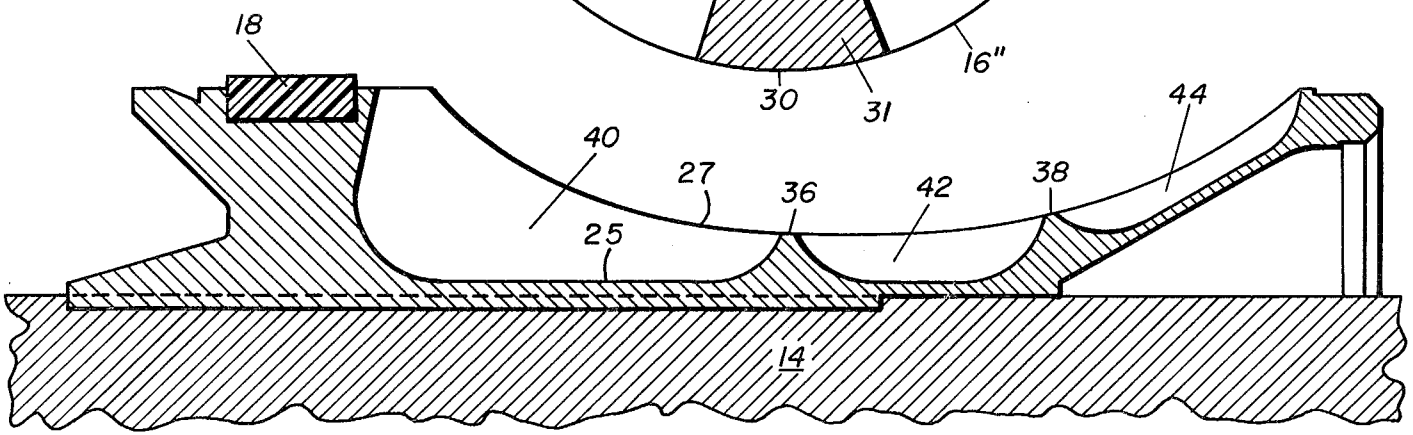
FIG. 7 is an alternate embodiment of a gusset type sabot.

Referring now to FIGS. 4, 7 a pair of longitudinal slots 28 having essentially parallel sides 29 are equally positioned in each of the sabot segments 16, 16', 16'' to form a longitudinally disposed central beam or gusset plate 30 having an "I" beam cross-sectional configuration and a pair of half beams or half gusset plate members 32 and 34 have upper concave surfaces 27 bottom substantially flat surfaces 25 which are parallel to central body section 14. The central beam 30 and half beams 32 and 34 provide the necessary structural support for the bore rider front end 24 and the sabot rear end 22 with reduced mass, thus enabling the subprojectile to attain a higher launch velocity and greater target effectiveness. The central beam or central gusset plate 30, as illustrated in FIG. 6, has an upper portion 31 being of triangular shape and modified integral "L" beams 32 and 34 of cross-sectional configuration which are substantially similar to the cross-section beam 30 when radially divided in half.

In operation, the optional shape of gusset plates 30, 32 and 34 may vary as the shape of the projectile and the gun bore diameter varies. The configuration shown in FIGS. 2, 4, 5 and 6 when sealed to accomodate a sabot-projectile assembly in a 105 mm gun bore results in a sabot weight reduction of approximately 1.2 lbs when compared to the saddle-shaped prior art sabot shown in FIGS. 1 and 3. The prior art sabot has a bore rider connecting mass 25 whose outline shape is defined by a solid body of rotation. Because of the reduction in cross section without loss of structural support for the bore rider and obturating sabot rear end the present invention provides a more efficient round in terms of total kinetic energy.

In the event that lateral support for the gussets 30, 32 and 34 become necessary, the present machining process, which utilized numerically controlled automated equipment, having rotary milling cutters can easily be modified in such a way that a radial gusset having lateral support is formed while longitudinal slots are being machined. FIG. 7 shows an alternate embodiment of the gusset saddle sabot illustrated in FIGS. 1, 4, 5 and 6. In the FIG. 7 embodiment, the lateral supports 36 and 38 are formed by programming the automated equipment to raise the milling tool twice while making the longitudinal slots 40, 42 and 44.

In summary, the present gusset sabot aforedescribed, enables a subcaliber projectile to be more efficient in terms of total kinetic energy delivered than prior art saddle sabot supported projectiles because a significant portion of the mass is reduced in connecting the bore rider sections to each other and to the interface of the sabot and the fin-stabilized subcaliber projectile without significant loss of necessary structural sabot strength.

While there has been described and illustrated specific embodiments of the invention, it will be obvious that various changes, modifications and additions can be made herein without departing from the field of the invention which should be limited only by the scope of the appended claims.

I claim:

1. A discarding sabot munition which comprises:

a subcaliber fin-stabilized projectile having a pointed front end, a fin-stabilized rear end and a cylindrically shaped central body section, said central body section having a plurality of external circular body threads disposed on a section thereof;

sabot means, operatively disposed circumambient said subcaliber projectile and intermediate said projectile front and rear ends, and interlocked with said body threads of said central body section, for acting as a reduced mass full-caliber carrier for said subcaliber fin-stabilized projectile, for propelling said subcaliber projectile with increased velocity and imparting increased kinetic energy thereto, for preventing inbore balloting of said subcaliber projectile during launch with minimum sabot means mass, and for discarding from said subcaliber projectile after launch, which includes;

a plurality of arcuately shaped sabot segments operatively positioned on said subcaliber projectile; said sabot segments further include;

a sabot segment member arcuately shaped bore rider front end;

a cylindrically shaped sabot body mid-section member integrally coupled to said bore rider front end;

a sabot segment member arcuately shaped rear end coupled to said sabot body mid-section member having an annular obturating ring groove peripherally located therein for fixedly holding said obturating ring;

an obturating ring operatively disposed in said sabot means for preventing propellant gas blow-by around said sabot means during launch and for releasing said sabot means to discard from said subcaliber projectile after lanuch;

gusset plate means for spacially positioning and structurally supporting said sabot bore rider front end with said sabot segment member rear end, for reducing the overall connecting mass requirements of said sabot body midsection member to enable said sabot munition to acquire increased velocity after launch, which includes;

a plurality of radially disposed gusset plates having longitudinal upper concave surfaces and bottom substantially flat surfaces which are parallel to said central body section thereon which includes;

a central beam member having a modified "I" beam cross-sectional configuration, said central beam member operatively disposed intermediate said sabot bore rider end and said sabot rear end; and a pair of half beam members equally disposed on both sides of said central beam member, each separated therefrom by longitudinally positioned slots which have essentially parallel sides.

2. A discarding sabot munition as recited in claim 1 wherein said modified "I" beam cross-sectional configuration includes:

an upper portion of triangular shape; and, a lower section of concave shape integrally connected with said upper portion.

3. A discarding sabot munition as recited in claim 2 wherein said pair of half beam members includes cross-sectional areas having modified "L" beam configuration substantially similar to said central beam member's cross-sectional configuration when radially divided in half.

4. A discarding sabot munition as recited in claim 3 wherein said plurality of radially disposed gusset plates include latteral support members operatively positioned in said longitudinal slots.

* * * * *